United States Patent [19]

Fletcher et al.

[11] 3,942,398

[45] Mar. 9, 1976

[54] ZERO TORQUE GEAR HEAD WRENCH

[76] Inventors: James C. Fletcher, Administrator of the National Aeronautics and Space Administration, with respect to an invention of, Allan R. McDougal, La Crescenta; Robert M. Norman, Glendale, both of Calif.

[22] Filed: Oct. 10, 1974

[21] Appl. No.: 513,690

[52] U.S. Cl. ..... 81/56; 81/57.31

[51] Int. Cl.[2] ..... B25B 17/00

[58] Field of Search ..... 81/57.31, 56, 57.36, 57.11

[56] References Cited

UNITED STATES PATENTS

| | | | |
|---|---|---|---|
| 1,405,739 | 2/1922 | Ratz | 81/57.11 |
| 3,247,741 | 4/1966 | Batten | 81/56 |
| 3,331,269 | 7/1967 | Sauter | 81/57.31 |
| 3,604,292 | 9/1971 | Sada | 81/57.11 |
| 3,759,119 | 9/1973 | Wing | 81/57.39 |

*Primary Examiner*—James L. Jones, Jr.
*Attorney, Agent, or Firm*—Monte F. Mott; Wilfred Grifka; John R. Manning

[57] ABSTRACT

A gear head wrench particularly suited for use in applying torque to bolts without transferring torsional stresses to bolt-receiving structures. The wrench is characterized by a coupling including a socket, for connecting a bolt head with a torque multiplying gear-train, provided within a housing having an annulus concentrically related to the socket and adapted to be coupled with a spacer interposed between the bolt head and the juxtaposed surface of the bolt-receiving structure for applying a balancing counter-torque to the spacer as torque is applied to the bolt head whereby the bolt-receiving structure is substantially isolated from torsional stress. As a result of the foregoing, the operator of the wrench is substantially isolated from any forces which may be imposed.

1 Claim, 5 Drawing Figures

ZERO TORQUE GEAR HEAD WRENCH

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

1. Field of the Invention

The invention generally relates to gear head wrenches and more particularly to an improved gear head wrench adapted rapidly to drive bolts into bolt-receiving structures without inducing therein substantial torsional stress.

It will be understood, of course, that as a bolt is torqued and thus "snugged-down" or tightened the head thereof is caused to engage the upper surface of a spacer normally interposed between the head and a selected bolt-receiving structure. As a consequence, frictional forces are developed between the juxtaposed surfaces of the head, spacer and structure so that torque is thus transmitted from the head to the spacer and thence to the bolt-receiving structure as the spacer attempts to rotate with the bolt head.

As can be readily appreciated by those familiar with the assembly of structural components, difficulty often is encountered in performing simple assembly techniques utilizing headed, screw-threaded bolts, because of torsional stresses induced in bolt-receiving structure as a consequence of torque applied to the heads of the bolts and transmitted to the structure through spacers, as the juxtaposed surfaces of the heads, spacers, and structure are brought into frictional engagement.

Such difficulties often are encountered, for example, in spacecraft assembly operations, wherein because of imposed weight limitations, structural components frequently are designed to withstand only expected forces applied to the structure during lift-off. Unfortunately, such components are subject to failure simply because of the existence of torsional stresses induced as a consequence of the tightening of certain bolts employed during assembly operations.

Additionally, as can be appreciated by those familiar with the fabrication and assembly of structure wherein bolts must be snugged-down in the assembly of components supported for rotation about an axis substantially paralleling the longitudinal axis of the bolts, a great deal of difficulty often is experienced in supporting such components against rotation induced as a consequence of torque transmitted thereto through spacers, such as washers and the like, interposed between the heads of the bolts and the adjacent surfaces of the components. For example, such difficulties often are experienced in the installation of propeller bolts, the torquing of axle bolts, a tightening of steam cylinder heads, and similar operations.

Finally, in instances wherein a bolt must be inserted and snugged-down in a space to which limited access is afforded, a great deal of difficulty often is encountered in inserting a bolt and washer into a bolt-receiving opening, such as an internally threaded bore. Consequently, the time expended in performing even simple assembly operations often results in increased labor costs because of the increased time required to perform such an operation.

2. Description of the Prior Art

Gear head wrenches, often referred to as torque wrenches and as torque multipliers, are notoriously old. Such devices, of course, are provided with a planetary gear train which serves to multiply input torque of the wrench. Such wrenches are provided with reaction bars attached to housings provided for the gear trains and are utilized to support the housings against rotary motion reactively induced as torque is applied to the input of the wrench for tightening threaded fasteners, such as bolts and the like.

Unfortunately, wrenches of the aforementioned type often are difficult to employ simply because reaction bars must be manipulated simultaneously with the input of torque to the torque input shaft, thus requiring that additional space be made available in which to manipulate the wrench. Moreover, and quite importantly, such wrenches simply include no means for isolating bolt-receiving structure from stress resulting from torque applied to the bolt head and transmitted through an interposed spacer, as the bolt is snugged-down.

It is, therefore the purpose of the instant invention to provide a gear head wrench having a capability of applying counter-torque to a spacer and adapted to be employed simply and efficiently for rapidly installing, in bolt-receiving structure, headed bolts circumscribed by annular spacers, such as washers, lugs, bosses and the like, while isolating the bolt-receiving structures from torque-induced stress.

OBJECTS AND SUMMARY OF THE INVENTION

It is, therefore, an object of the instant invention to provide a gear head wrench which overcomes the aforementioned difficulties and disadvantages.

Another object is to provide an improved gear head wrench which particularly is adapted to snug-down a bolt head, screw-threaded without inducing substantial torsional stress in structure which serves to receive the bolt.

It is another object to provide a gear head wrench particularly suited for use in applying torque to bolts having concentrically related spacers interposed between the heads thereof and the adjacent surfaces of bolt-receiving structure.

It is another object to provide a gear head wrench particularly adapted to apply counteracting torque to an annular spacer interposed between the head of a screw-threaded bolt and an adjacent surface of bolt-receiving structure as torque is applied to the head of the bolt for thus balancing the torque applied to the spacer for isolating the bolt-receiving structure from torsional stress.

These and other objects and advantages are achieved through a gear head wrench having a socket, or similar coupling, adapted to connect the wrench with the head of a screw-threaded bolt received in an opening formed in a structural component, a coupling for connecting the wrench with an annular spacer, such as a washer, lug, or boss, disposed in juxtaposition with the surface of the structural component and concentrically related with the bolt, a first drive train for applying torque in a given direction to the bolt and second drive train, for applying reactive counter-torque to the spacer, for thereby restraining the spacer from rotation induced as a consequence of torque applied to the bolt head as the juxtaposed surfaces of the component, bolt head and spacer become frictionally engaged, as will become more readily apparent by reference to the following description and claims in light of the accompanying drawings.

DESCRIPTION OF THE PREFERRED EMBODIMENT

Figure 1:
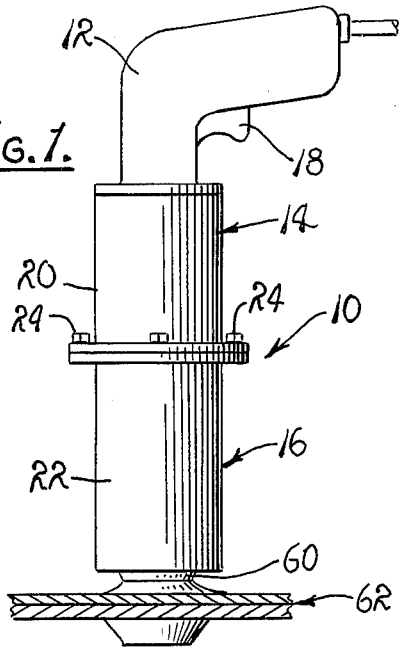
FIG. 1 is a side view of a gear head wrench which embodies the principles of the instant invention.

Referring now to the drawings, with more particularity, wherein like reference characters designate like or corresponding parts throughout the several views, there is shown in FIG. 1 a gear head wrench, generally designated 10, which embodies the principles of the instant invention. As a practical matter, the wrench 10 includes a so-called pistol grip 12, connected to a wrench motor 14, which is, in turn connected with a drive unit 16.

The pistol grip 12 is of a suitable design and preferably includes a manipulatable actuator button 18 through which the motor 14 is selectively energized. It will, of course, be appreciated that while the wrench motor 14, as shown, comprises a portable electrically energizable motor, a stand-supported pneumatic motor, or any other suitable motor can be employed equally as well. In any event, it is to be understood that for purposes of acquiring a rotary output, an operator energizes the motor 14 in a manner well understood by those familiar with power tools.

As shown, the motor 14 is encased in a cylindrical housing 20 to which the pistol grip 12 is rigidly affixed, while the drive unit 16 is encased in a housing 22 also connected with the housing 20. Mated annular flanges, not designated, are provided for the housings 20 and 22, while bolts 24 extended through openings formed in the flanges are provided for joining the housings in a manner well understood by those familiar with conventional assembly techniques.

The wrench motor 14 is suitably coupled with a shaft 26 which serves as a torque input shaft for the drive unit 16. The torque shaft 26, of course, is supported for rotary motion and is connected with a torque multiplier, generally designated 28, through which torque is multiplied and transmitted to a shaft 30 which serves as a torque output shaft.

Figure 2:
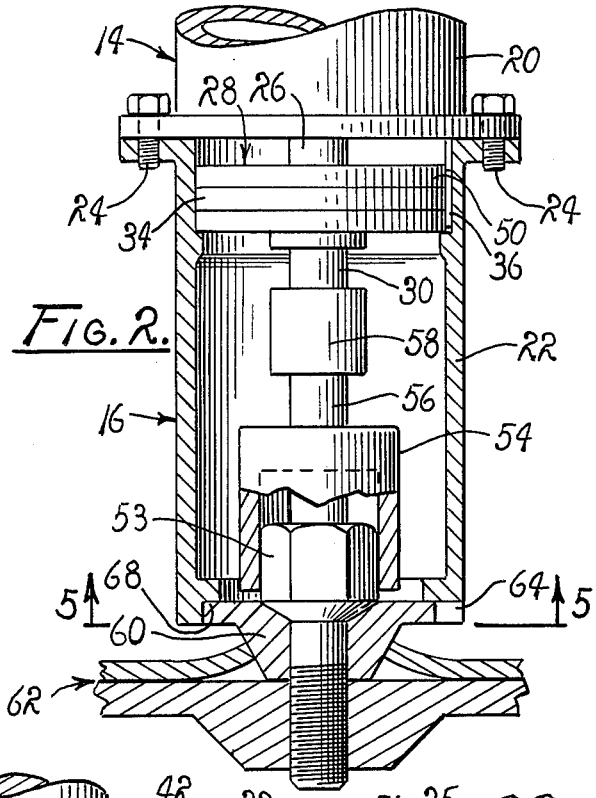
FIG. 2 is an enlarged, partially sectioned, fragmented view of the gear head wrench including a gear train for applying torque to a bolt head and counter-torque to a spacer concentrically related with the head of the bolt.
Figure 3:
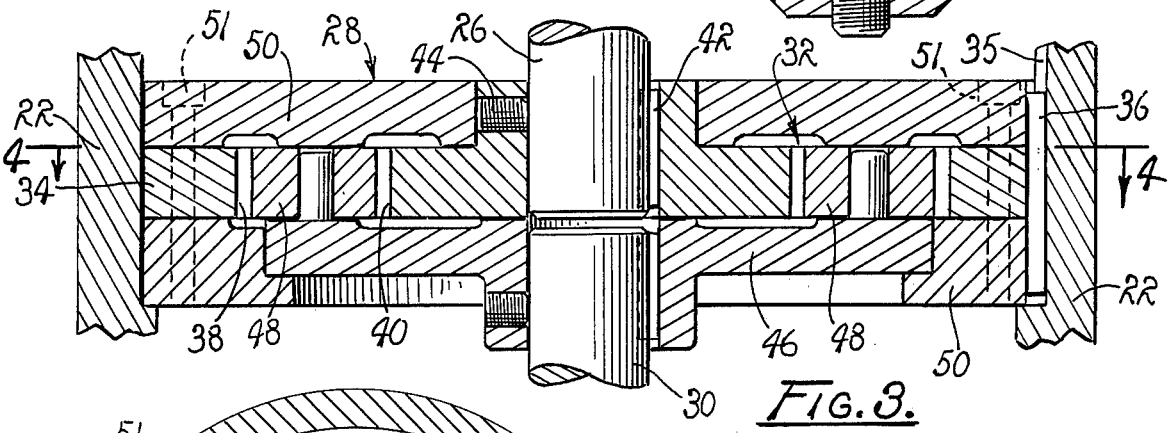
FIG. 3 is a partially sectioned, fragmented view of the gear train employed in transmitting torque and counter-torque to the bolt and spacer shown in FIG. 2.
Figure 4:
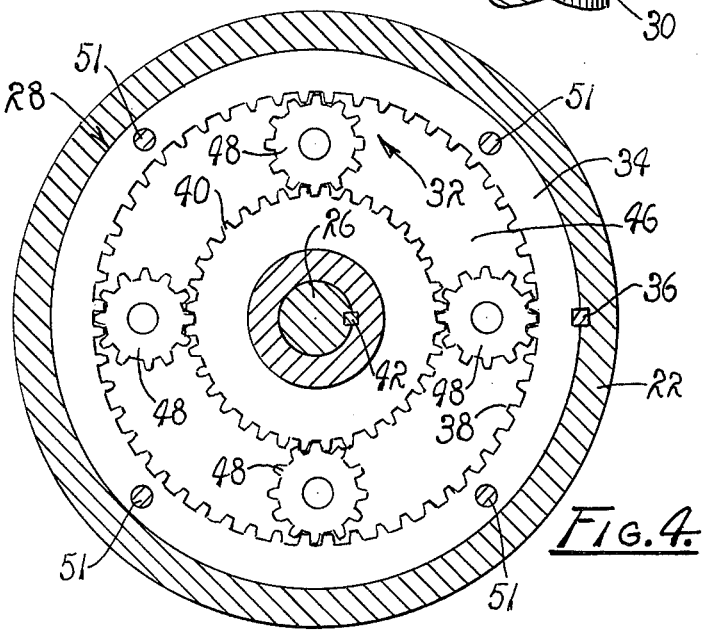
FIG. 4 is a top plan view of the gear train shown in FIG. 3.
Figure 5:
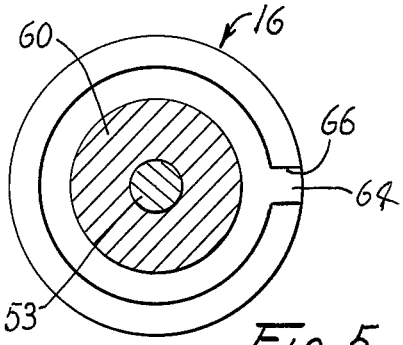
FIG. 5 is a cross-sectional view taken generally along line 5—5 of FIG. 2.

The torque multiplier 28 is of a known design and, preferably, includes a gear train, generally designated 32, seated in a rigid shell 34, FIG. 2. The shell 34, in turn, is concentrically related to the housing 22 and rigidly secured thereto. As a practical matter, the shell 34 is seated on an annular shoulder 35, provided internally of the housing 22 and is connected with the housing 22 through a coupling including a key 36, seated in mated key-ways, not designated, provided in the housing 22 and the shell 34.

Since the gear train 32 is of known design, a detailed description thereof is not deemed necessary to provide a complete understanding of the instant invention. However, it is to be understood that preferably, the shell 34 includes an internal wall surface which defines an internal gear 38 of an annular configuration. Concentrically related to the internal gear 38 is a sun gear 40. This gear, in turn, is rigidly connected to the shaft 26 extended concentrically therethrough. Where desired, the sun gear 40 and the shaft 26 are provided with mated key-ways, not designated, for receiving therein a key 42 through which a rigid coupling of the sun gear 40 to the shaft 26 is achieved. Moreover, where desired, a setscrew 44 additionally is provided for coupling the sun gear 40 with the shaft 26.

The shaft 30 is supported in coaxial alignment with the shaft 26 and is provided with a driving plate 46 fixed thereto in concentric relation therewith. An annular array of planetary gears 48 is rotatably supported by the driving plate 46. These gears are meshed with both the internal gear 38 and the sun gear 40.

It should be appreciated that the plate 46 is connected with the shaft 30 in any suitable manner. Where desired, the plate 46 is connected with the shaft 30 in a manner similar to that in which the sun gear 40 is connected with the shaft 26. Additionally, it is to be understood that a pair of oppositely disposed, suitably configured cover plates 50 are joined to the shell 34 by an array of fasteners 51 for thus enclosing the gear train 32. It should, in view of the foregoing, be apparent that as torque is applied to the output shaft 30, by the shaft 26 acting through the gear train 32, a counteracting torque is applied, reactively, to the housing 22 through the shell 34. Moreover, torque thus applied to the housing 22 substantially equals the torque applied to the shaft 30.

In order to transmit the torque applied to the shaft 30 to a bolt, the shaft 30 is connected at its distal end with the bolt 53 through a suitable coupling 54. As a practical matter, the coupling 54 is of a configuration dictated by the configuration of the head of the bolt. As shown, the coupling 54 comprises a female socket suitably connected with the shaft 30 through a stub shaft 56 and a coaxially aligned union 58. However, the manner in which the coupling 54 is connected with the shaft 30 may be varied as desired.

As shown in FIG. 2 of the drawings, the bolt 53 is circumscribed by a spacer, designated 60. As illustrated, the spacer 60 is of an annular configuration and is seated in an interposed relationship between the juxtaposed surfaces of the head of the bolt and bolt-receiving structure, generally designated 62, within which there is provided an internally threaded bore. It is significant that the spacer 60 is frictionally engaged with the structure 62 to thereby provide a frictional lock. The spacer 60, as shown, comprises a lug collar having a radially extended key 64 configured to be received in a radially extended key-way 66 provided in the housing 22.

The key-way 66 is formed in an annulus, not designated, defined by the open end of the housing 22. Hence, it will be appreciated that the spacer 60 is mated and thus connected with the housing 22 as the consequence of the key 64 being inserted into the key-way 66. Additionally, within the housing 22, where so desired, there is provided an annular shoulder 68 against which the spacer 60 is permitted to seat as an axially directed force is applied to the housing 22 for thus applying an axially directed force to the spacer 60 and the coupling 54 as the bolt 53 is driven into the bore or other opening within which it is seated.

It should, at this point, be appreciated that the spacer 60 can readily be received by the annulus defined by the open end of the housing 22 and supported in this position by the shoulder 68 and the key-way 66 for thus facilitating a rapid insertion of the bolt 53 into bolt-receiving structure 62. Moreover, it should be apparent that while the bolt-receiving structure 62 is illustrated as including an internally screw-threaded bore for receiving the bolt 53, nuts or other suitable structure secured against rotation in a suitable manner can be provided for receiving the bolt. Additionally, the annulus defined by the open end of the housing 22 is of any suitable configuration dictated by the configuration of the spacer 60. Moreover, the key 64 and key-way 66 can be omitted in favor of other couplings, including splines, flats and similar structure.

Therefore, while the annulus defined by the open end of the housing 22, as shown in FIG. 2, is configured to receive a collar having a radially extended key, the housing 22 can be configured to receive a spacer, such as a washer, boss, or lug collar of substantially any configuration through which angular motion of the spacer relative to the housing 22 is precluded.

OPERATION

It is believed that in view of the foregoing description, the operation of the device will readily be understood and it will be briefly reviewed at this point.

With the gear head wrench 10 assembled in the manner hereinbefore described, the head of a bolt 53 is inserted into the coupling 54 while a spacer 60 of an annular configuration is mounted on the bolt 53 in a concentric relationship therewith. The key 54 of the spacer 60 is seated in the key-way 66 as the spacer is urged into engagement with the surface of the shoulder 68 formed in the housing 22. In this configuration, the bolt 53 is readied to be received within a suitable opening such as an internally threaded bore defined in the bolt-receiving structure 62.

An operator gripping the pistol grip 12 positions the bolt 53 in the bolt-receiving opening and depresses the button 18 for thus energizing the wrench motor 14. As the wrench motor 14 is energized, rotary motion is imparted to the shaft 26. This motion is, in turn, transmitted to the sun gear 40 for driving the planetary gears 48 in a common orbit about the sun gear. Since the pistol grip 12 is held by an operator, a reactive force is applied manually to the housing 22 of the drive unit 16, through the housing 20 of the wrench motor 14. Consequently, rotary motion is imparted to the bolt 53 via the coupling 54, shafts 56 and 30 and the torque multiplying gear train 32.

Of course, as the bolt 53 approaches a seated relationship within the bore formed in the bolt-receiving structure, the torque required to advance the bolt is increased in order to overcome the frictional forces developed between the surface of the bolt head and the upper surface of the spacer 60. Due to the fact that the housing 22 is connected directly with the internal gear 38, the counter-torque applied to the spacer 60, by the housing 22 via the key 64 seated in the key-way 66, substantially equals the torque applied to the bolt head 53 for overcoming the frictional forces developed between the surfaces of the spacer and the bolt head. Consequently, the spacer is supported in fixed relation with the bore and the torsional stress transmitted by that resulting from torque required to overcome thread friction and thread lead friction is transmitted to the spacer 60 as a consequence of the aforementioned frictional lock. Thus, the bolt-receiving structure 62 is effectively isolated, by the spacer 60, from torsional stress resulting from frictional engagement of the lower surface of the bolt head with the upper surface of the spacer 60.

In view of the foregoing, it should readily be apparent that the wrench of the instant invention provides a practical solution to the perplexing problem of rapidly inserting bolts into bolt-receiving structure without transmitting torsional stress to the bolt-receiving structure through annular spacers interposed between the heads of the bolts and the adjacent surface of bolt-receiving structures.

Although the invention has been herein shown and described in what is conceived to be the most practical and preferred embodiment, it is recognized that departures may be made therefrom within the scope of the invention.

What is claimed is:

1. An improved gear head wrench adapted to be employed for torquing bolts seated in a threaded bore formed in a structural member and circumscribed by a spacer comprising:

A. a motor including a first housing and a selectively driven torque input shaft projected axially from said first housing; and B. a drive unit disposed in juxtaposition with said motor and connected thereto for torquing a selected bolt seated in a threaded bore formed in a structural member and having a concentrically related spacer characterized by a radially extended key and a face disposed in frictional engagement with the member including,

1. a second housing of a substantially cylindrical configuration rigidly affixed to said first housing in coaxial alignment with said torque input shaft and having an open end disposed in spaced relation with said first housing,

2. a sun gear concentrically related to one end of said torque input shaft, being rigidly affixed thereto and supported thereby for driven rotation about an axis coincident with the longitudinal axis of symmetry for said second housing,

3. a torque output shaft disposed within said second housing and supported for driven rotation in coaxial alignment with said torque input shaft,

4. a driving plate disposed in juxtaposed, coaxial relation with said sun gear and rigidly affixed to said torque output shaft,

5. an annular array of planetary gears mounted for rotation on said driving plate in concentric relation with said torque output shaft and in coplanar meshed relation with said sun gear,

6. an internal gear disposed in circumscribing, meshed relation with said annular array of planetary gears and rigidly affixed to said second housing,

7. coupling means affixed to said torque output shaft in spaced relation with said drive plate adapted to receive in coupled relation the head of said bolt, and

8. a receiver for said spacer including an annulus defined by the open end of said second housing concentrically related to said coupling means, including a keyway for receiving the radially extended key, whereby the housing is adapted to receive said spacer in an interlocked relationship as the coupling is caused to receive the head of said bolt.

* * * * *